US005975970A

United States Patent [19]

Daikoku

[11] Patent Number: 5,975,970

[45] Date of Patent: Nov. 2, 1999

[54] OIL PUMP UNIT FOR OUTBOARD MOTOR

[75] Inventor: Keisuke Daikoku, Hamamatsu, Japan

[73] Assignee: Suzuki Kabushiki Kaisha, Hamamatsu, Japan

[21] Appl. No.: 09/018,038

[22] Filed: Feb. 3, 1998

[30] Foreign Application Priority Data

Feb. 4, 1997 [JP] Japan ..... 9-021714

[51] Int. Cl.[6] ..... B63H 21/10

[52] U.S. Cl. ..... 440/88

[58] Field of Search ..... 440/75, 76, 77, 440/78, 88, 900

[56] References Cited

U.S. PATENT DOCUMENTS 5,163,394 11/1992 Koishikawa et al. ..... 440/88
5,215,164 6/1993 Shibata ..... 440/88

FOREIGN PATENT DOCUMENTS 5-26175 2/1993 Japan .
8-100614 4/1996 Japan .

*Primary Examiner*—Stephen Avila
*Attorney, Agent, or Firm*—Finnegan, Henderson, Farabow, Garrett & Dunner, L.L.P.

[57] ABSTRACT

An outboard motor comprises an engine holder arranged to be mounted to a hull, an engine disposed in an upper portion of the engine holder in a mounted state thereof, an oil pan disposed in a lower portion of the engine holder, a crank shaft vertically disposed in the engine, a cam shaft disposed to extend in parallel to the crank shaft, and a lubricating device including an oil pump unit disposed to a lower surface of the engine holder and adapted to circulate an oil in the engine. The oil pump unit comprises a pump case having a case body to be mounted to the engine holder, a pump drive shaft operatively connected to the cam shaft for operating the oil pump disposed on the lower surface of the engine holder, suction port and discharge port. The pump drive shaft is detachably connected to the cam shaft to be slidable in a vertical direction in the mounted state, and the suction port and the discharge port operatively communicated with suction port and discharge port of the engine, respectively.

5 Claims, 13 Drawing Sheets

OIL PUMP UNIT FOR OUTBOARD MOTOR

BACKGROUND OF THE INVENTION

The present invention relates to an oil pump unit for an outboard motor.

An engine unit of an outboard motor is mounted vertically in such a way that a crank shaft of an engine is vertically disposed. The engine is formed by assembling a crank case, a cylinder block, a cylinder head and the like. If the engine is a four-stroke-cycle engine, an oil pan is disposed below the engine. A lubricating device having an oil pump for pumping up oil accumulated in the oil pan is provided to lubricate the inside portion of the engine.

A conventional lubricating device for an outboard motor is disclosed in, for example, Japanese Patent Laid-Open Publication No. HEI 8-100614. The disclosed device has a structure that an oil pan is disposed below a cylinder block and a cylinder head. An oil pump is, in the oil pan, disposed below the cylinder head and is operated by a cam shaft rotatively supported in the cylinder head.

Another conventional lubricating apparatus for an outboard motor is disclosed in, for example, Japanese Patent Laid-Open Publication No. HEI 5-26175. The disclosed device has a structure that an oil pan is joined to a portion of the crank shaft which projects over the lower surface of the engine. The oil pump is directly operated by the crank shaft.

If the oil pump is joined to the lower surface of the engine, an operation for solely removing the engine unit from the outboard motor for maintenance or the like is performed in a state where the oil pump appears and projects over the lower portion of the engine. Thus, it is inconvenient because the engine cannot be placed on a flat workbench to perform the maintenance. Furthermore, there is apprehension that the engine may be damaged because of an external factor.

If a member, for example, a, crank shaft, except for the cam shaft is employed as a drive shaft for the oil pump, the disposed drive shaft obstructs an oil dropping passage formed from the crank case to the oil pan. Thus, there is apprehension that the oil dropping performance is deteriorated.

SUMMARY OF THE INVENTION

An object of the present invention is to substantially eliminate defects or drawbacks encountered in the prior art described above and to provide an oil pump unit for an outboard motor capable of enabling a maintenance operation to be performed easily and smoothly.

Another object of the present invention is to provide an oil pump unit for an outboard motor which is attempted to improve oil dropping performance.

These and other objects can be achieved according to the present invention by providing an oil pump unit for an outboard motor having an engine holder arranged to be mounted to a hull, an engine disposed in an upper portion of the engine holder in a mounted state thereof, an oil pan disposed in a lower portion of the engine holder, a crank shaft vertically disposed in the engine, a cam shaft disposed to extend in parallel to the crank shaft, and an oil pump unit disposed to a lower surface of the engine holder and adapted to circulate an oil in the engine, the oil pump unit comprising:

a pump case having a case body to be mounted to the engine holder and a case cap;

a pump drive shaft operatively connected to the cam shaft for operating the oil pump unit;

suction means for sucking an oil; and discharge means for draining the oil, wherein the pump drive shaft is detachably connected to the cam shaft to be slidable in a vertical direction in the mounted state, and the suction means and discharge means are formed as suction hole and discharge hole which are operatively communicated with suction port and discharge port formed to the engine, respectively.

In preferred embodiments, a thrust receiver is mounted to the oil pan disposed below the pump drive shaft to be coaxial therewith so as to be movable in an axial direction thereof. The pump drive shaft is provided with a top end to which a projection is formed so as to project over the top end of the pump drive shaft, and an engaging member having a recess arranged to be engaged with the projection is individually formed at a lower end of the cam shaft in a manner that the pump drive shaft and the cam shaft are connected to each other to be integrally rotatable.

The thrust receiver is formed at a central portion thereof with a tool insertion opening extending in an axial direction and the pump drive shaft is formed with a groove at the lower end portion thereof with which a tool is engaged, the tool insertion hole being positioned just below the lower end portion of the pump drive shaft.

The engine is provided with an engine cover positioned below the thrust receiver and the engine cover has an inner surface to which a rib for preventing dropping-off of the thrust receiver is formed.

According to the structures of the present invention of the characters mentioned above, the oil pump can be disposed while the oil dropping performance is not deteriorated. Since the oil pump does not follow the engine operation when the outboard motor is decomposed, the operation and working for maintaining the engine can easily and smoothly be performed. Since the oil pump is not damaged attributable to an external factor when the engine is maintained, breakage of the oil pump can be effectively prevented. Moreover, the performance for discharging oil can be improved.

Furthermore, the location of the thrust receiver permits the drive shaft and the cam shaft to easily be connected to each other when the engine is again mounted. The pump drive shaft and the cam shaft can reliably be connected to each other, and the tapered portion for performing a centering operation which is required when the cam face of the cam shaft is formed can be formed at an end of the cam shaft.

The pump drive shaft and the cam shaft can easily be allowed to coincide with each other when they are connected to each other.

Still furthermore, the location of the stopping rib for the thrust receiver prevents the separation of the pump drive shaft from the cam shaft even if the thrust is loosen.

The nature and further features of the present invention will be made more clear from the following descriptions made with reference to the accompanying drawings.

DESCRIPTION OF THE PREFERRED EMBODIMENT

An embodiment of the present invention will be described hereunder with reference to the accompanying drawings.

Figure 1:
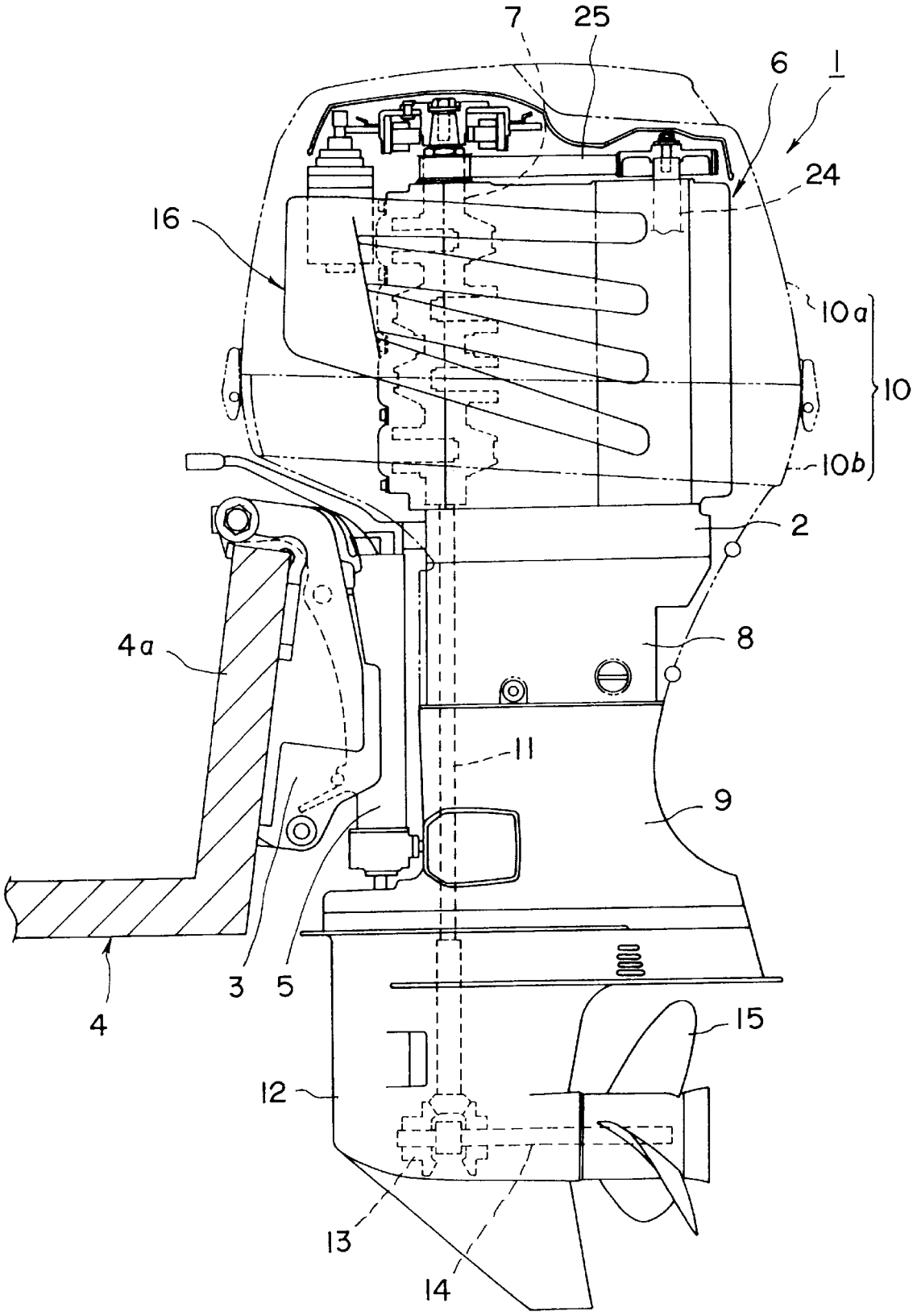
FIG. 1 is a left-hand side view showing an outboard motor provided with an oil pump of one embodiment according to the present invention.

FIG. 1 is a left-hand side view showing an outboard motor to which the present invention is applied.

As shown in FIG. 1, an outboard motor 1 has an engine holder 2. The outboard motor 1 is mounted on a transom 4*a* of a hull 4 through a bracket 3 joined to the engine holder 2. The outboard motor 1 is mounted in such a manner that the outboard motor 1 is able to horizontally rotate about a swivel shaft 5 vertically joined to the rear portion of the bracket 3.

An engine 6 is mounted on the upper portion of the engine holder 2 and a crank shaft 7 is substantially vertically disposed in the engine 6. An oil pan 8 is disposed in the lower portion of the engine holder 2, while a drive-shaft housing 9 is disposed in the lower portion of the oil pan 8.

The engine 6 is covered with an engine cover 10. The engine cover 10 can be vertically separated into, for example, an upper cover section 10*a* and a lower cover section 10*b*. The lower cover section 10*b* can be separated horizontally. The engine holder 2, the coil pan 8 and the lower portion of the engine 6 are covered with the lower cover section 10*b*, while the upper portion of the engine 6 is covered with the upper cover section 10*a*.

A drive shaft 11 connected to the lower end of the crank shaft 7 extends through the oil pan 8 and the drive-shaft housing 9. Thus, when the engine 6 is driven, the drive shaft 11 rotates a propeller 15 through a bevel gear 13 and a propeller shaft 14, the bevel gear 13 being disposed in the gear case 12 formed in the lower portion of the drive-shaft housing 9.

Figure 2:
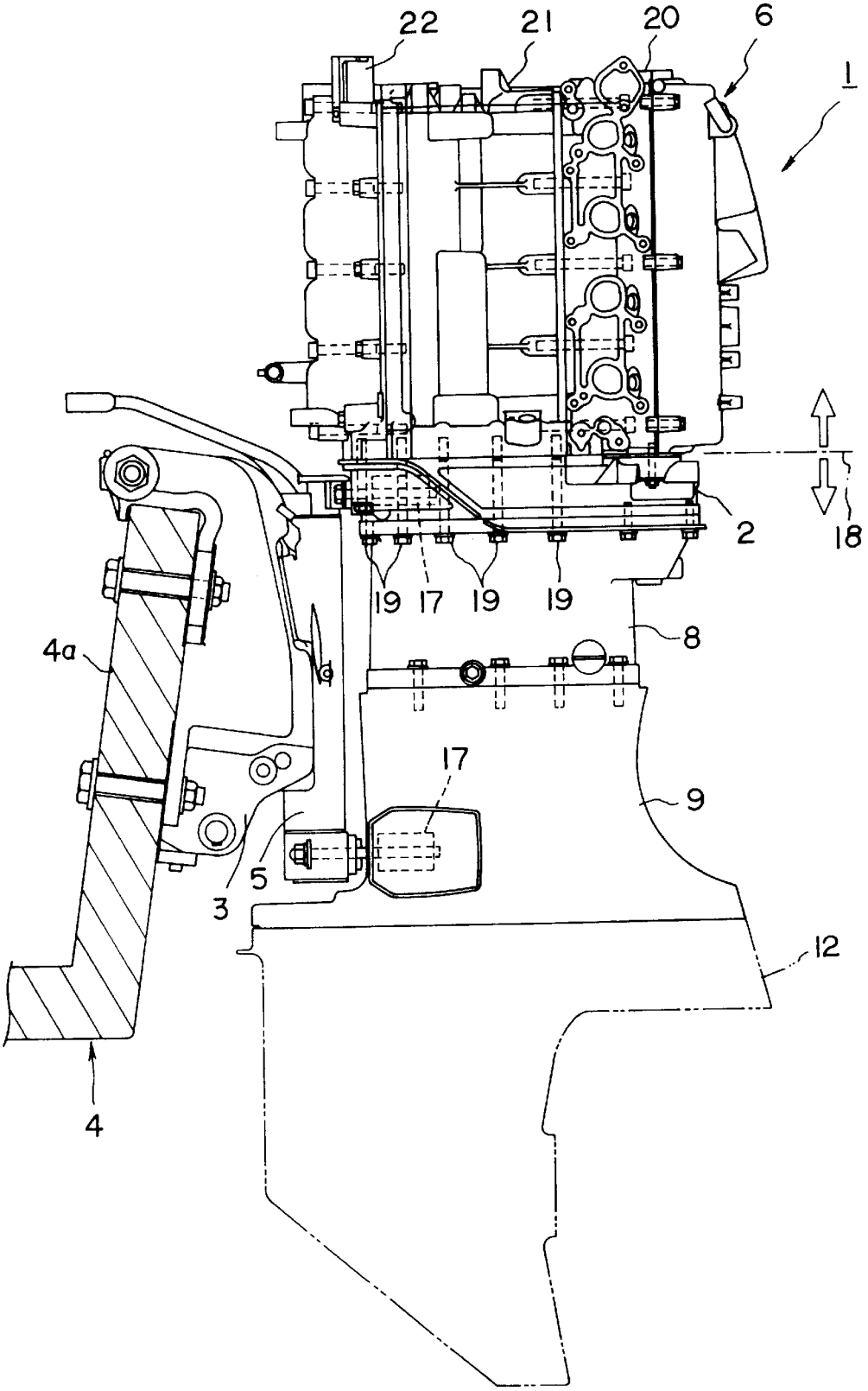
FIG. 2 is a left-hand side view showing a state in which an engine cover is removed from the outboard motor shown in FIG. 1 and associated units, such as a suction unit, is also removed.

FIG. 2 shows a state in which the engine cover 10 is removed from the outboard motor 1 shown in FIG. 1 and associated units, such as a suction unit 16, are also removed. As shown in FIG. 2, a pair of mounting portions 17 are joined to the front ends of the engine holder 2 and the drive-shaft housing 9. The upper and lower mounting portions 17 are supported by the top and lower ends of the swivel shaft 5.

As indicated with an arrow shown in FIG. 2, the outboard motor 1 can be sectioned vertically at the engagement surface 18 between the engine 6 and the engine holder 2 indicated with a dot and dash line. In a usual state, the engine 6, the engine holder 2 and the oil pan 8 are integrated by means of fixing bolts 19.

Figure 3:
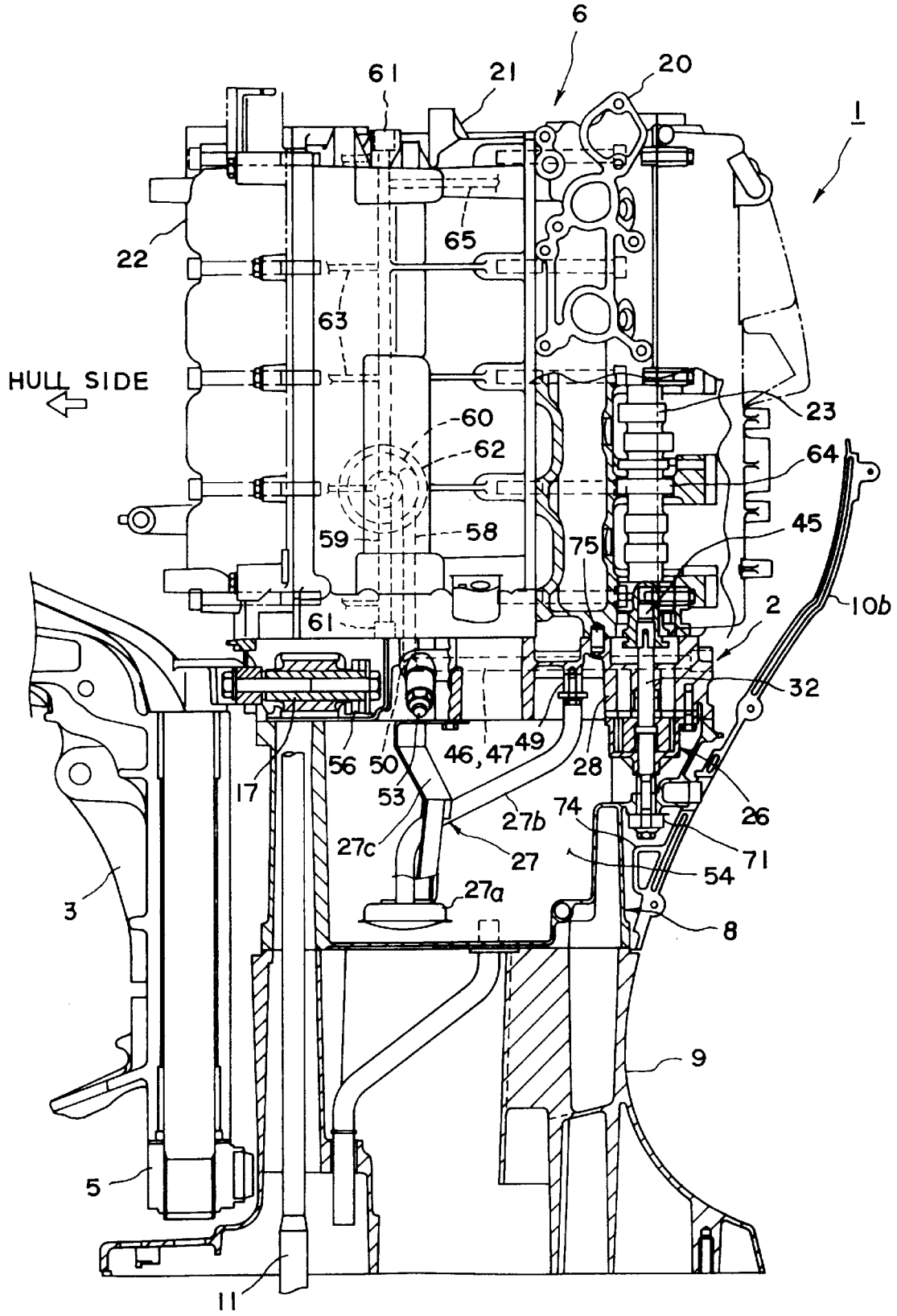
FIG. 3 is an enlarged left-hand side view showing an engine, an engine holder and an oil pan shown in FIG. 2.
Figure 4:
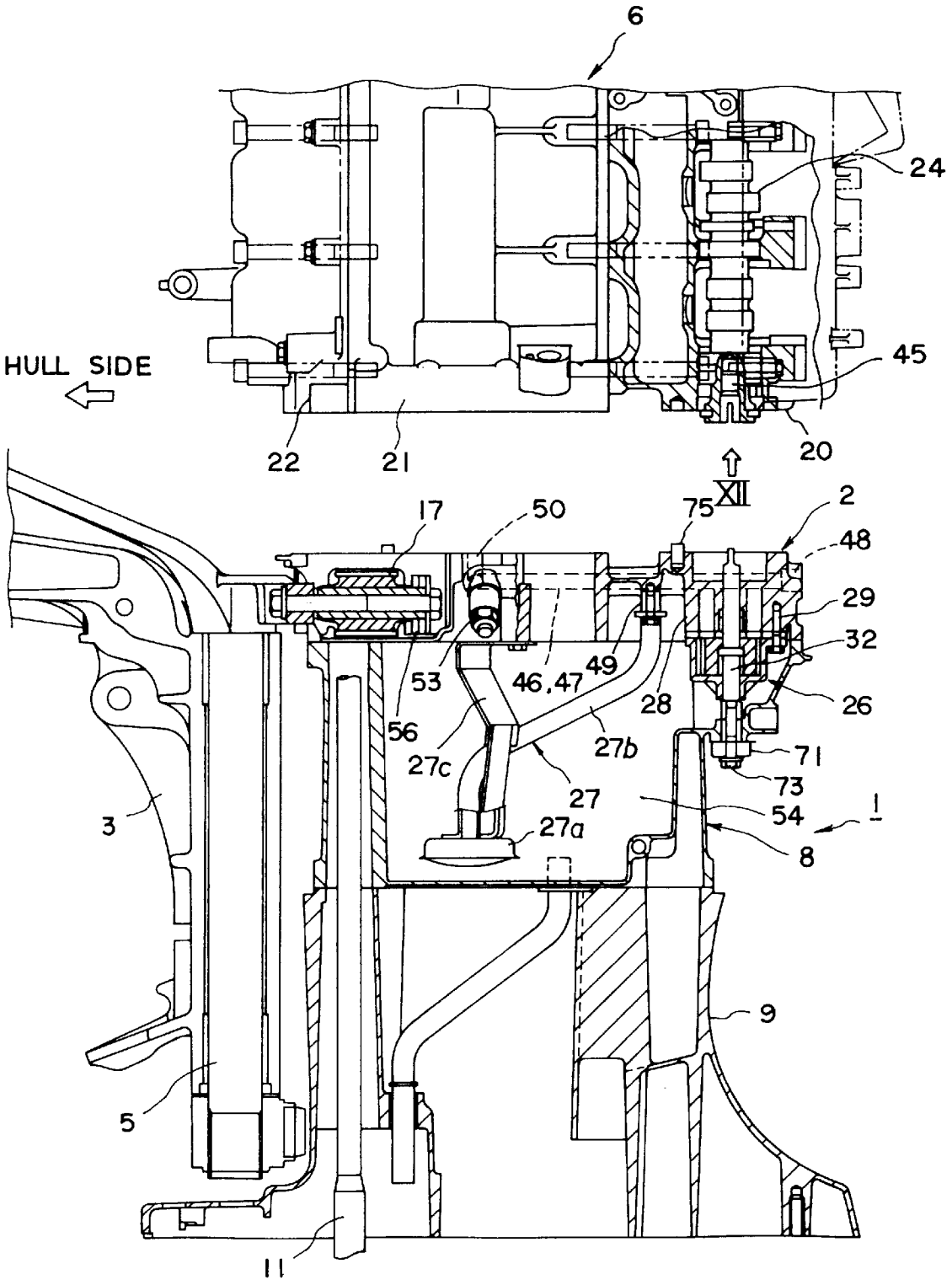
FIG. 4 is a left-hand side view showing a state in which the engine shown in FIG. 3 is removed from the engine holder and the oil pan.

FIG. 3 is an enlarged view of the engine 6, the engine holder 2 and the oil pan 8 shown in FIG. 2, in which cross sections of a portion of the engine 6, the engine holder 2 and the oil pan 8 are shown. FIG. 4 shows a state in which the engine 6 shown in FIG. 3 is separated from the engine holder 2 and the oil pan 8 in order to perform maintenance of the engine 6.

As shown in FIGS. 2 to 4, the engine 6 is, for example, a water cooled four-cylinder engine. The cylinder head 20, the cylinder block 21, the crank case 22 and the like of the engine 6 are laid in the longitudinal direction. In this embodiment, the crank case 22 is disposed at the forward end, i.e. a portion adjacent to the bracket 3, and the cylinder head 20 is disposed in the rearmost portion.

The cylinder head 20 accommodates a cam shaft 24 for opening/closing suction valves and exhaust valves, not shown, the cam shaft 24 being parallel to the crank shaft 7. Rotations of the crank shaft 7 are transmitted to the cam shaft 24 through a timing belt 25 (see FIG. 1). Thus, the valves can be operated.

The outboard motor 1 is provided with a lubricating unit for lubricating the inside portion of the engine 6. The lubricating unit is arranged, in such a manner that the oil pump 26 upwards sucks oil accumulated in the oil pan 8 to supply oil to the engine 6. The structure of the lubricating unit will be described hereunder.

Figure 5:
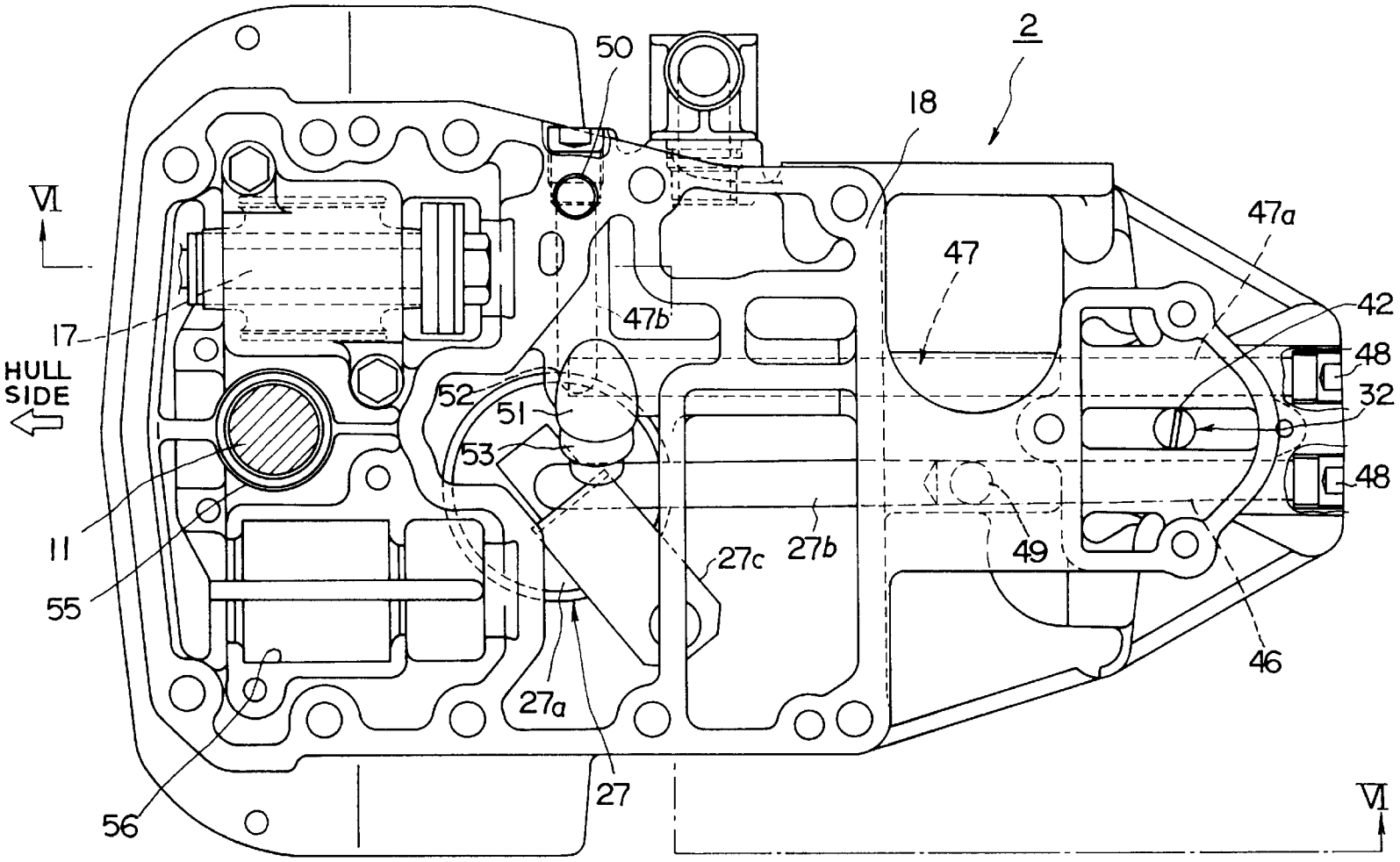
FIG. 5 is a top view showing the engine holder.
Figure 6:
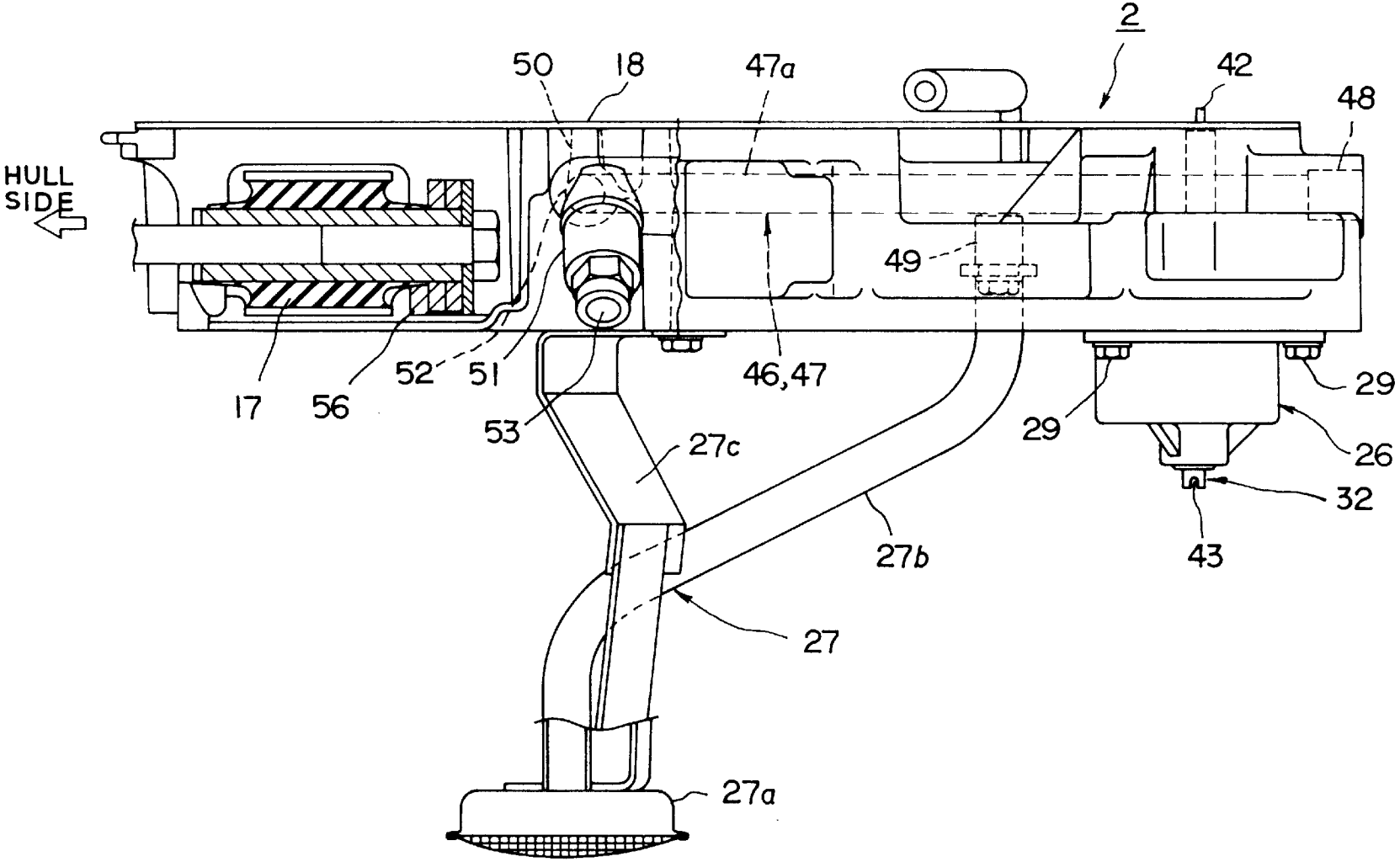
FIG. 6 is a cross sectional view taken along the line VI—VI shown in FIG. 5.
Figure 7:
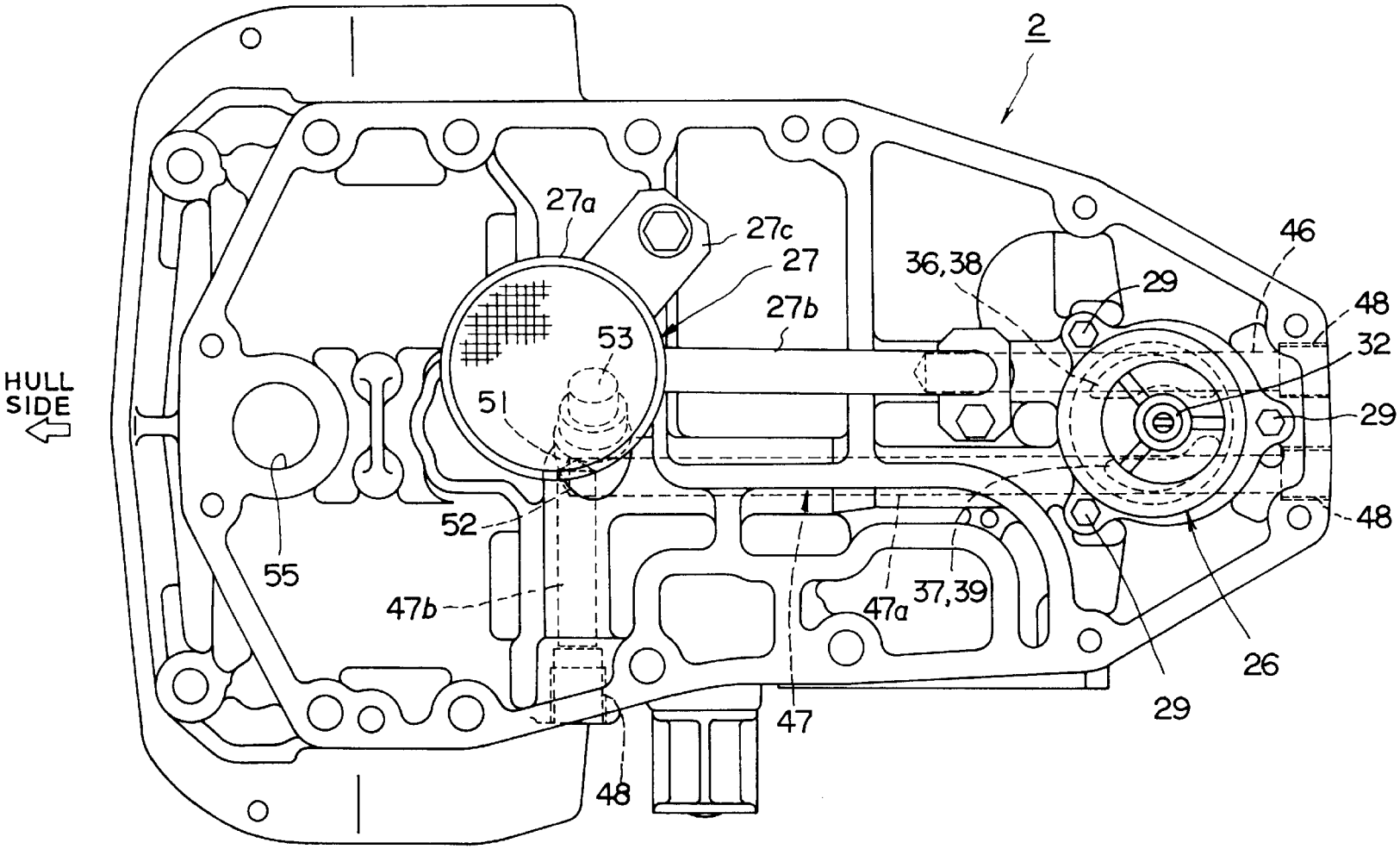
FIG. 7 is a bottom view showing the engine holder.
Figure 8:
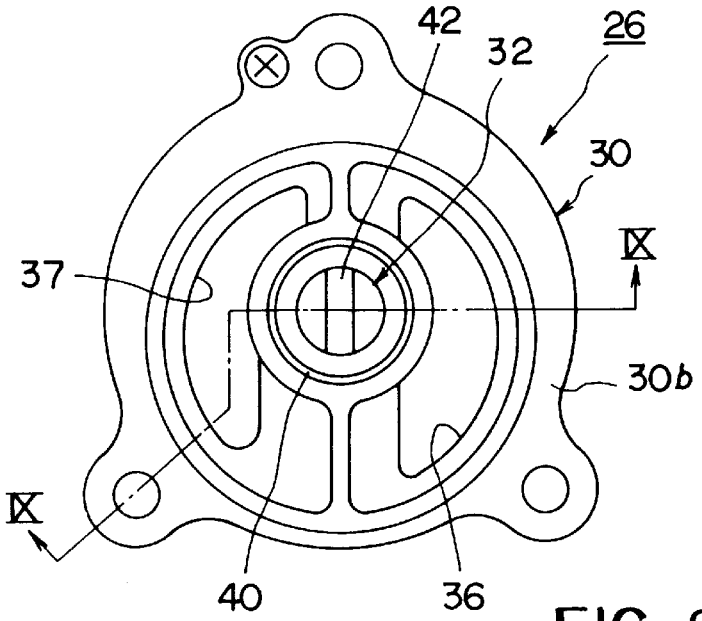
FIG. 8 is a top view showing the oil pump.
Figure 9:
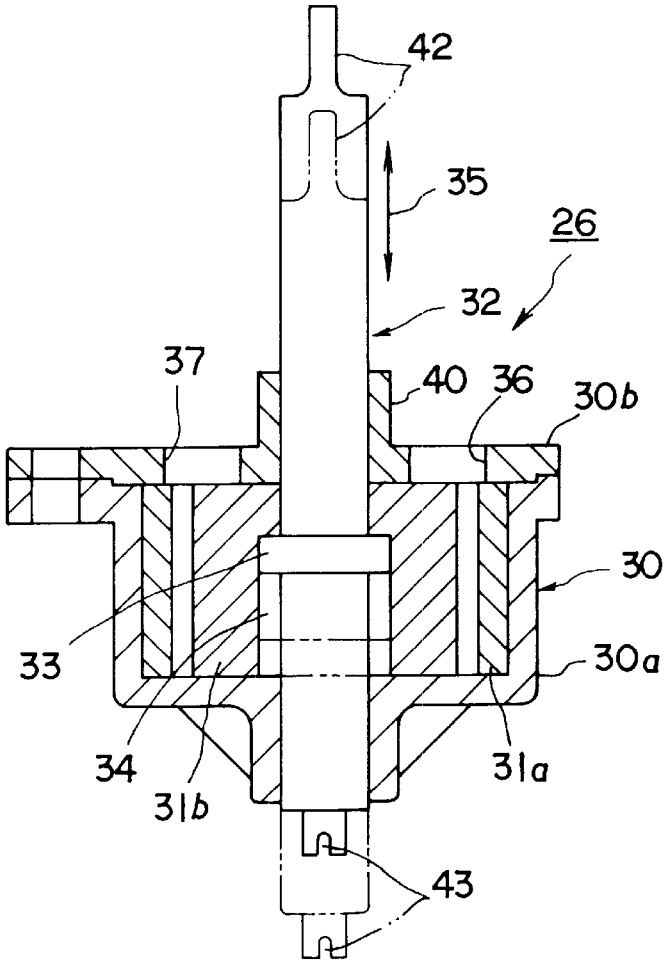
FIG. 9 is a cross sectional view showing the oil pump taken along the line IX—IX shown in FIG. 8.
Figure 10:
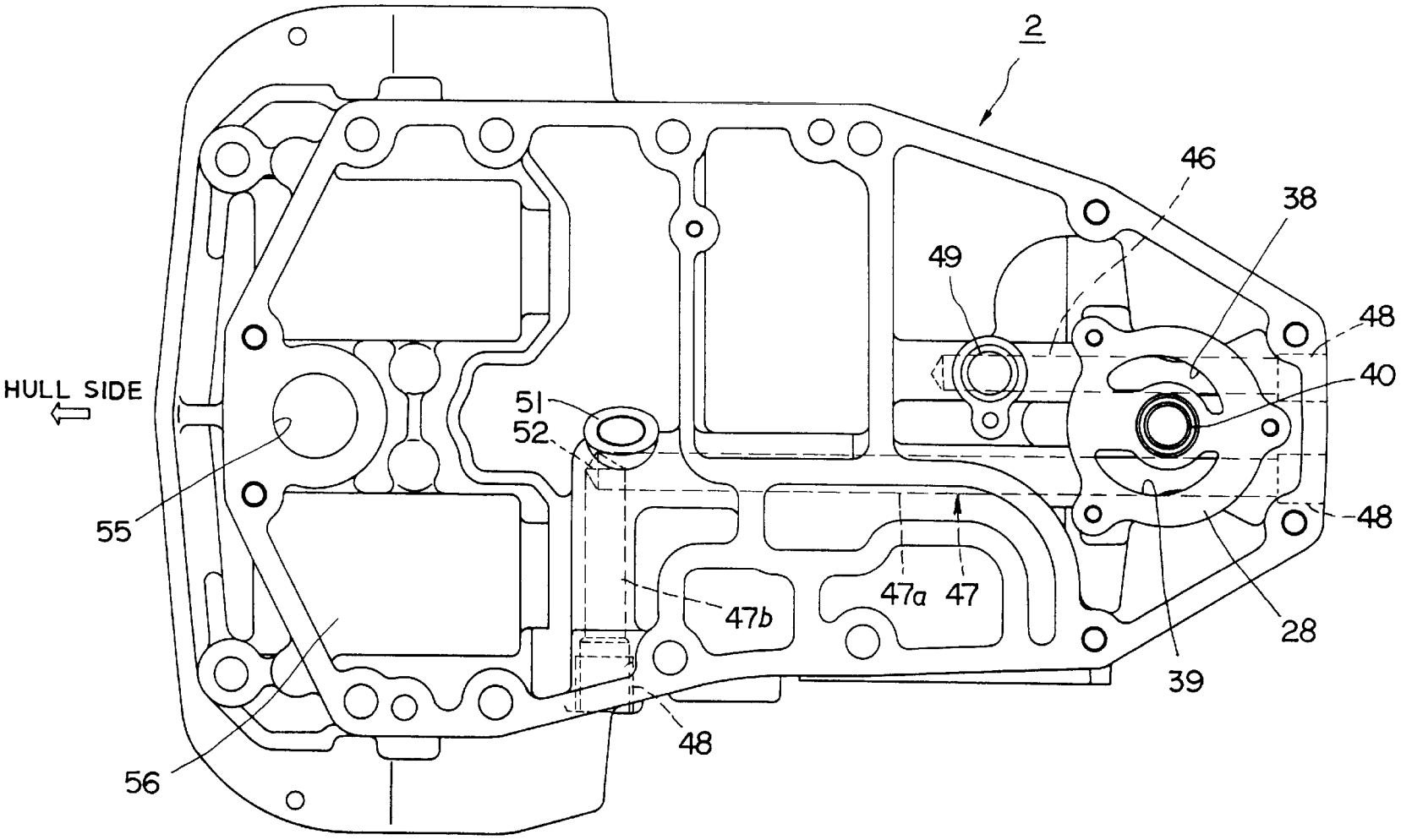
FIG. 10 is a bottom view showing the engine holder in a state in which the oil pump and an oil strainer are removed from the lower surface of the engine holder.

FIG. 5 is a top view of the engine holder 2. FIG. 6 is a cross sectional view taken along the line VI—VI shown in FIG. 5. FIG. 7 is a bottom view of the engine holder 2. FIG. 8 is a top view of the oil pump 26. FIG. 9 is a cross sectional view of the oil pump 26 taken along the line IX—IX shown in FIG. 8. FIG. 10 is a bottom view showing the engine holder 2 in a state in which the oil pump 26 and an oil strainer 27, to be described later, are removed from the lower surface of the engine holder 2.

As shown in FIGS. 3 to 5 and 7, the oil pump 26 is disposed in the rearmost portion of the lower surface of the engine holder 2 (that is, in the right-hand portion of FIGS. 3 and 4), the oil pump 26 being disposed just below the cam shaft 24 in the cylinder head 20. As shown in FIG. 10, a flat pump retainer 28 is formed in the rearmost portion of the lower surface of the engine holder 2. As shown in FIG. 7, the oil pump 26 is secured to the pump retainer 28 by, for example, three bolts 29.

As shown in FIGS. 8 and 9, the oil pump 26 is usual trochoid pump comprising a pump case 30 having a case body 30*a* formed into a cup-like shape opened upwards and a flat case cap 30*b*. The oil pump 26 further comprises an outer rotor 31*a*, an inner rotor 31*b* and a pump drive shaft 32 which are accommodated in the pump case 30.

The case body 30*a* and the case cap 30*b* of the pump case 30 are clamped together to the pump retainer 28 of the engine holder 2 with bolts 29. The pump drive shaft 32 vertically penetrates the pump case 30. The inner rotor 31*b* is joined to an intermediate portion of the pump drive shaft 32 in such a manner that the inner rotor 31*b* is rotated together with the pump drive shaft 32. The outer rotor 31*a* is disposed eccentrically with respect to the inner rotor 31*b*. An outer gear, not shown, formed on the outer surface of the inner rotor 31*b* is engaged with the inner surface of an inner gear, not shown, formed on the inner surface of the outer rotor 31*a*.

The pump drive shaft 32 has a drive pin 33 in substantially the central portion thereof. The drive pin 33 is engaged with the inner rotor 31*b* so that the drive torque is transmitted. A drive-pin engagement portion 34 of the inner rotor 31*b* is formed to provide a slit shape extending in the vertical direction. As indicated with an arrow 35 in FIG. 9, the pump drive shaft 32 is able to freely slide within the range of the drive-pin engagement portion 34.

The case cap 30*b* has a suction hole 36 and a discharge hole 37 each of which has a crescent shape and which are formed opposite to each other in such a manner that the pump drive shaft 32 is disposed between the suction hole 36 and the discharge hole 37. A suction port 38 and a discharge port 39 each having a crescent shape are formed in the pump retainer 28 of the engine holder 2 at positions corresponding to the suction hole 36 and the discharge hole 37 (see FIG. 10). Moreover, the pump retainer 28 has a female portion 41 which receives a male portion 40 of the case cap 30*b* and which is formed in order to locate the oil pump 26.

A projection 42 is formed over the top end of the pump drive shaft 32 of the oil pump 26 in such a manner that the projection 42 projects over the upper surface of the engine holder 2. A groove 43, with which a tool to be described later is engaged, is formed in the lower end surface of the pump drive shaft 32. Moreover, an engagement member 45 having a recess 44 arranged to be engaged to the projection 42 is provided for the lower end of the cam shaft 24 of the engine 6. Thus, the pump drive shaft 32 and the cam shaft 24 are connected to each other in such a manner that integral rotation and separation are permitted. When the engine 6 is driven, the cam shaft 24 is rotated and the oil pump 26 is hence driven.

On the other hand, an oil suction passage 46 and an oil discharge passage 47 extending from the oil pump 26 are formed integrally in the engine holder 2. For example, as shown in FIG. 5, the oil suction passage 46 is formed to extend forwards from the rear end of the engine holder 2 to pass through the left-hand side of the pump drive shaft 32 of the oil pump 26 as viewed in a plan view. The oil discharge passage 47 is an L-shape passage formed by connecting a first discharge passage 47*a* and a second discharge passage 47*b* to each other. The first discharge passage 47*a* is formed to extend forwards from the rear end of the engine holder 2 to pass through the right-hand side of the pump drive shaft 32 of the oil pump 26 as viewed in a plan view. On the other hand, the second discharge passage 47*b* is formed to extend from the trailing end of the first discharge passage 47*a* towards a left-hand portion as viewed in a plan view. As described above, the oil suction passage 46 and the first discharge passage 47*a* of the oil discharge passage 47 are formed in parallel with each other in such a manner that the pump drive shaft 32 of the oil pump 26 is interposed between the oil suction passage 46 and the first discharge passage 47*a*. Outer openings of these oil passages 46 and 47 are closed by caps 48.

A suction port 38 and a discharge port 39 which are formed in the pump retainer 28 are connected to the corresponding oil suction passage 46 and the first discharge passage 47*a* of the oil discharge passage 47. The oil suction passage 46 has a length shorter than the first discharge passage 47*a* of the oil discharge passage 47. A strainer port 49 opened in the lower surface of the engine holder 2 is connected to the leading end of the oil suction passage 46. An outlet port 50 opened in the upper surface of the engine holder 2 is connected to the second discharge passage 47*b* at a position adjacent to the outer ends of the second discharge passage 47*b*.

A relief-valve retainer 51 is formed on the lower surface of the engine holder 2. A relieve-valve passage 52 formed in the central portion of the relief-valve retainer 51 and having a short length is connected to a position adjacent to the intersection between the first discharge passage 47*a* of the oil discharge passage 47 and the second discharge passage 47*b*. A relief valve 53 is mounted on the relief-valve retainer 51.

The oil strainer 27 is connected to the strainer port 49 which is an inlet port of the oil suction passage 46. The oil strainer 27 is also secured to the lower surface of the engine holder 2. The oil strainer 27 comprises a strainer portion 27*a* serving as a port for sucking oil, a strainer pipe 27*b* extending upward from the strainer portion 27*a* in an S-shape and a support leg 27*c* similarly extending upward from the strainer portion 27*a* and formed through a metal working process.

As shown in FIGS. 3 and 4, a major portion of the internal space in the oil pan 8 is used by an oil reservoir tank 54 which is filled with oil. When the oil pan 8 is secured to the lower surface of the engine holder 2, the strainer portion 27*a* of the oil strainer 27 is submerged to reach the bottom of the oil reservoir tank 54. A drive-shaft insertion opening 55, through which the drive shaft 11 is inserted, is formed in the front end portion of each of the engine holder 2 and the oil pan 8. A pair of right and left mounting portions 56 are formed in the front portion of the engine holder 2. The mounting portions 17 are joined to the mounting portions 56.

A pair of right and left oil returning passages 57 are integrally formed with the engine holder 2 at positions adjacent to the pump retainer 28. The oil returning passages 57 are passages through which oil supplied to the inside portion of the engine 6, in particular, oil supplied to the cylinder head 20 is returned to the oil pan 8.

As shown in FIG. 3, the cylinder block 21 of the engine 6 has an oil-supply passage 58 formed vertically and a main oil-gallery 59 running parallel with the oil-supply passage 58. The oil-supply passage 58 is formed to be connected to the outlet port 50 formed in the engine holder 2. The upper end of the oil-supply passage 58 is connected to an oil-filter retaining portion 60 formed on the right-hand surface of the cylinder block 21.

The main oil-gallery 59 is formed to be perpendicular to the oil-filter retaining portion 60. The upper and lower openings of the main oil-gallery 59 are closed by caps 61. An oil filter 62 is interchangeably mounted on the oil-filter retaining portion 60. Moreover, the oil-supply passage 58 is connected to the main oil-gallery 59 through the inside portion of the oil filter 62.

A bearing-oil passage 63 connected to a bearing portion, not shown, for the crank shaft 7 and a head-oil passage 65 are branched from the main oil-gallery 59. The head-oil passage 65 extends to the inside portion of the cylinder head 20 so as to be connected to a bearing 64 of the cam shaft 24 and a valve moving unit, not shown.

Figure 11:
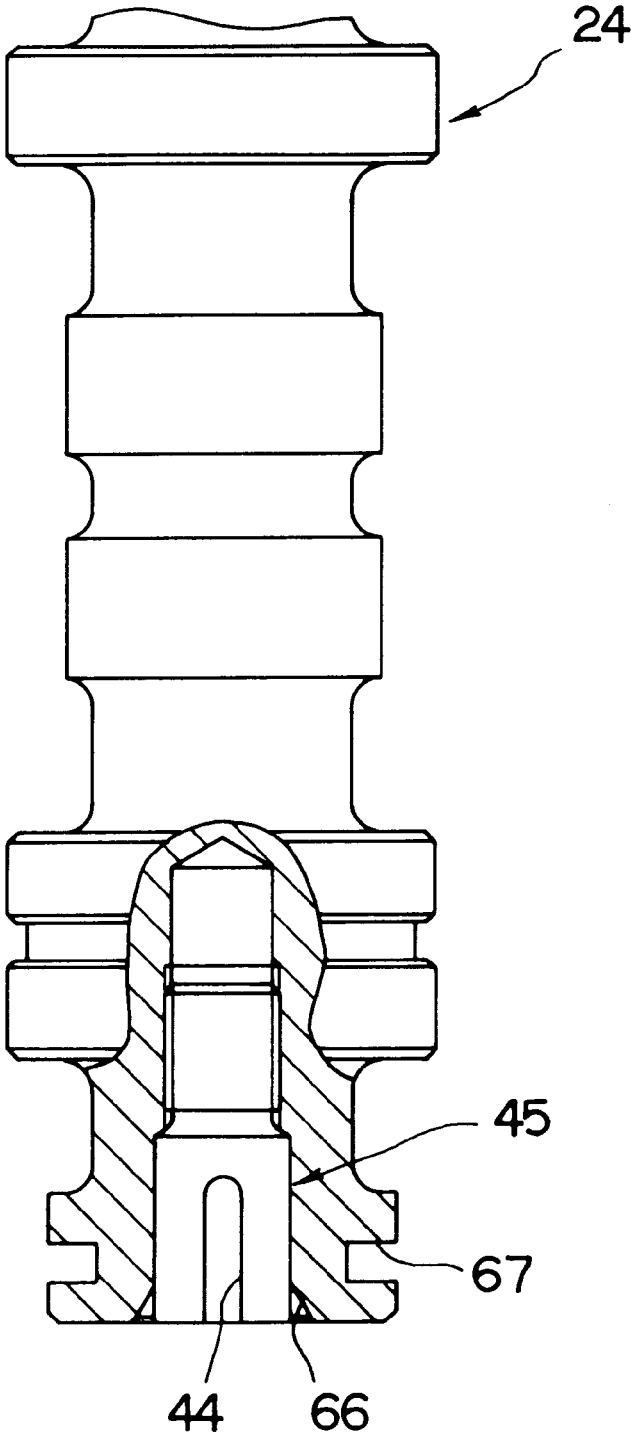
FIG. 11 is an enlarged view showing a lower end of a cam shaft.
Figure 12:
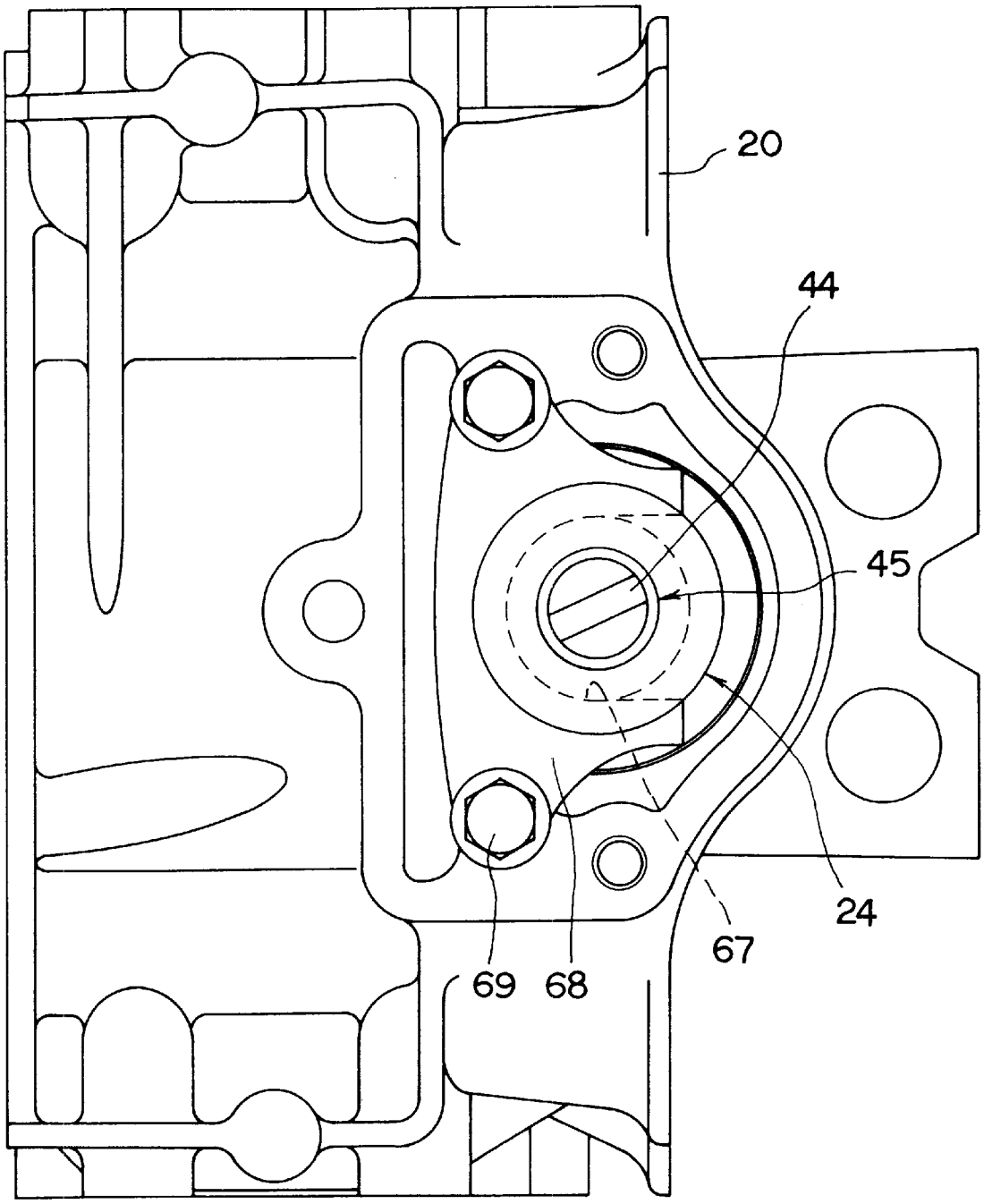
FIG. 12 is a view viewed from an arrowed direction XII shown in FIG. 4.

FIG. 11 is an enlarged view showing a lower end of the cam shaft 24 in which the cross sectional shape of a portion of the lower end is illustrated. FIG. 12 is a diagram showing the lower end of the cam shaft 24 when it is viewed from a lower portion as indicated with an arrow XII shown in FIG. 4. As shown in FIGS. 11 and 12, an engagement member 45, having a recess 44 arranged to be engaged with a projection 42 formed at the top end of the pump drive shaft 32, is formed at the lower end of the cam shaft 24, the engagement member 45 being formed individually from the cam shaft 24. The engagement member 45 is joined to the lower end of the cam shaft 24 by dint of a thread. Since the engagement member 45 is formed individually from the cam shaft 24, a tapered portion 66 for performing a centering working when a cam face of the cam shaft 24 is formed can be formed at an end of the cam shaft 24.

An outer groove 67 is formed around the cam shaft 24 at the lower end thereof. A cam-thrust bearing 68 is engaged with the outer groove 67. The cam-thrust bearing 68 is secured to the lower surface of the cylinder head 20 with bolts so that the cam shaft 24 is supported at a predetermined position.

Figure 13:
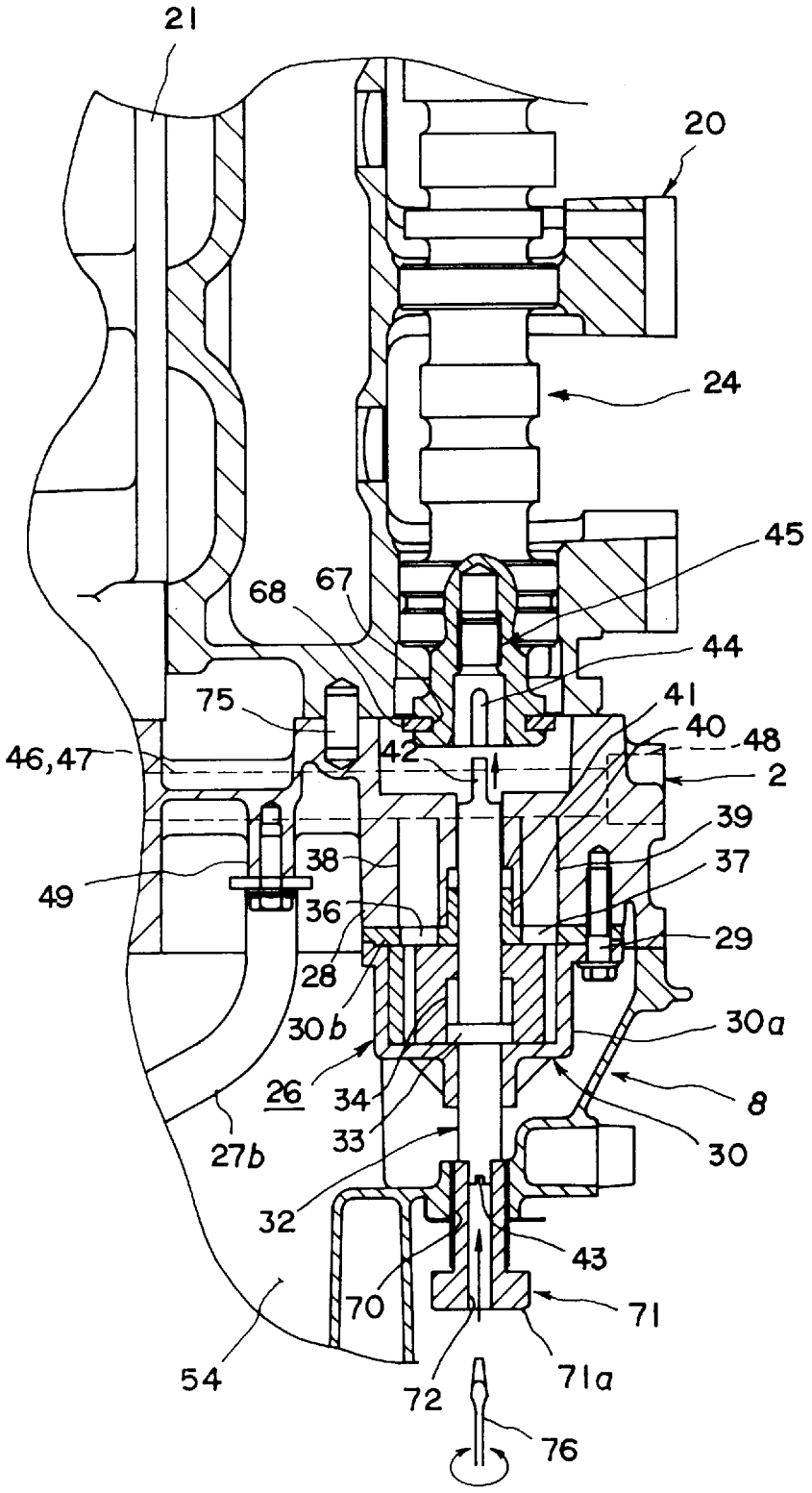
FIG. 13 is an enlarged elevational section showing a portion including the joining portion between the oil pump and the cam shaft.

FIG. 13 is an enlarged and vertical cross sectional view showing the joint portion between the oil pump 26 and the cam shaft 24 in a state where the engine 6 after the maintenance is again mounted on the engine holder 2. As shown in FIG. 13, a maintenance-permission opening 70 which is coaxial with the pump drive shaft 32 is formed in the oil pan 8 just below the pimp drive shaft 32 of the oil pump 26. A thrust receiver 71 is connected to the maintenance-permission opening 70 from a lower position by dint of a thread in such a manner that vertical movement of the thrust receiver 71 is permitted. A tool insertion opening 72 extending in the axial direction is formed in the central portion of the thrust receiver 71. A head 71*a* of the thrust receiver 71 is formed into a shape, for example, a hexagonal shape to which a tool can be engaged.

Figure 14:
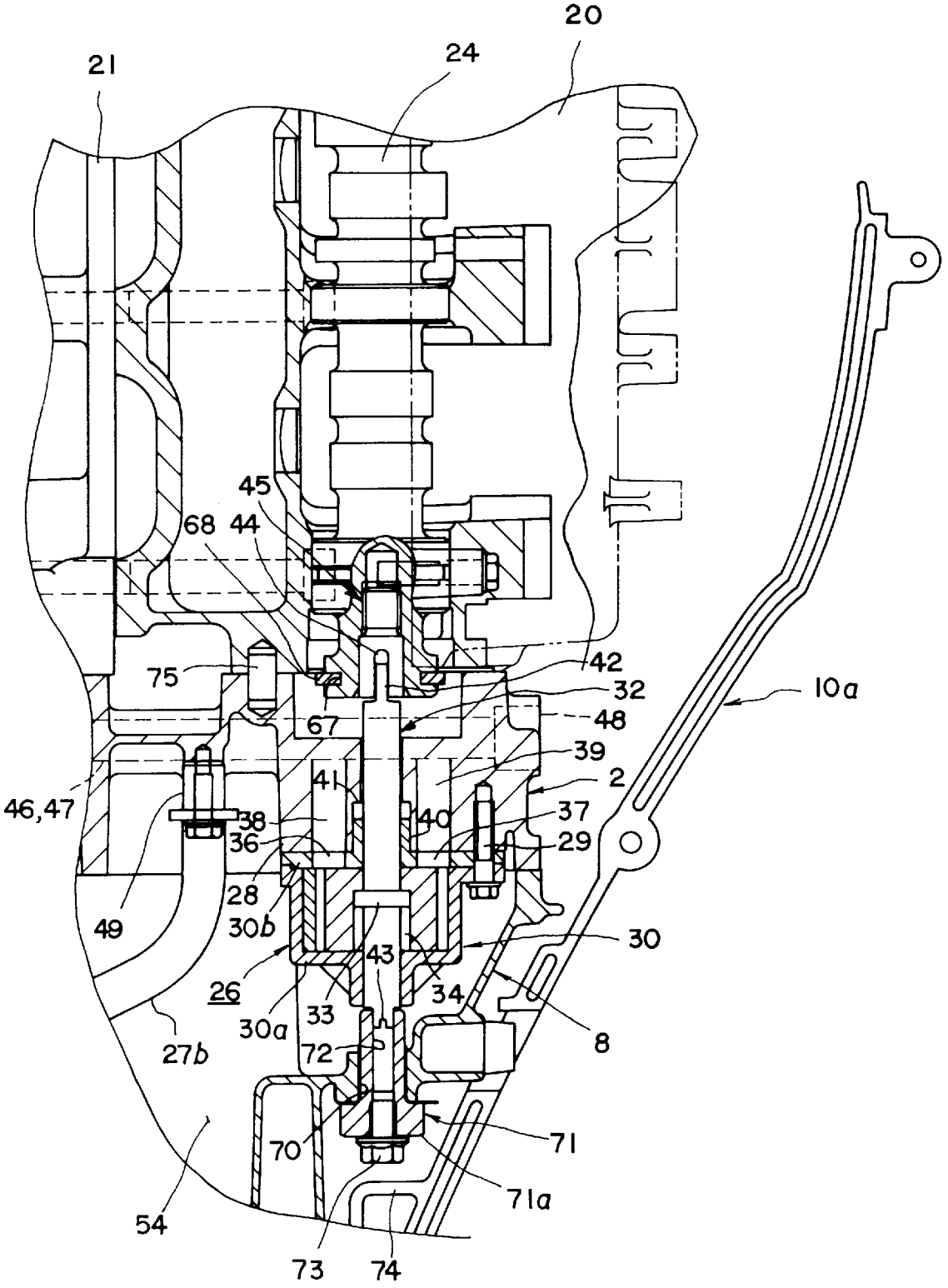
FIG. 14 is an enlarged elevational section showing the portion including the joining portion between the oil pump and the cam shaft.

As shown in FIG. 14, the tool insertion opening 72 is usually closed by a blind cap 73. Moreover, a stopping rib 74 of a thrust receiver 71 is formed on the inner surface of the lower cover 10*b* at a position just below the blind cap 73 in such a manner that a somewhat large gap is formed from the blind cap 73. Further, a knocking pin 75 for causing the axis of the cam shaft 24 to coincide with the axis of the pump drive shaft 32 is provided for the joining surface between the cylinder head 20 and the engine holder 2.

Referring to FIGS. 13 and 14, a process for joining the cam shaft 24 and the pump drive shaft 32 together when the engine 6 is again mounted will now be described.

When the engine 6 after the maintenance is again mounted on the engine holder 2, the thrust receiver 71 is sufficiently loosen to cause the pump drive shaft 32 to be moved downwards because of the deadweight of the pump drive shaft 32. Thus, the lower end of the cam shaft 24 does not come in contact with the top end of the pump drive shaft 32. As a result, the joining portions are not brought into contact with each other due to carelessness when the engine 6 is mounted. Thus, breakage of the joining portions can be prevented.

After the engine 6 has been mounted, a tool, for example, a driver 76, is inserted into the tool insertion opening 72 formed in the thrust receiver 71 from a lower position. Then, the leading end of the tool is engaged with the groove 43 formed in the lower end portion of the pump drive shaft 32. The tool is rotated while the pump drive shaft 32 is pushed upwards. Thus, the projection 42 formed at the top end of the pump drive shaft 32 is engaged with the recess 44 formed in the lower end portion of the cam shaft 24. Then, the thrust receiver 71 is clamped to hold the lower end of the pump drive shaft 32 so that the pump drive shaft 32 and the cam shaft 24 are connected to each other as shown in FIG. 14 to be rotatable.

After the pump drive shaft 32 and the cam shaft 24 have been connected to each other, the tool insertion opening 72 of the thrust receiver 71 is closed by the blind cap 73. Thus, leakage of oil from the oil pan 8 can be prevented. Since the stopping rib 74 is formed to project over the inner surface of the lower cover 10*b* at the position just below the blind cap 73, undesirable separation of the pump drive shaft 32 from the cam shaft 24 can be prevented even if the thrust receiver 71 is loosen and dropped.

Since the outboard engine 1 is separable along the engagement surface 18 between the engine 6 and the engine holder 2 and the oil pump 26 is provided adjacent to the engine holder 2, the oil pump 26 does not follow the engine 6 when the outboard engine 1 is decomposed. Therefore, the engine 6 can easily be maintained on a flat workbench. Moreover, damage of the oil pump 26 because of an external factor which takes place during maintenance of the engine 6 can be prevented satisfactorily.

The structure according to the present invention is arranged in such a manner that a member, for example, the crank shaft 7 except for the cam shaft 24, is not used as the drive shaft for the cam shaft 24. Since the structure according to the present invention is arranged in such a manner that the oil pump 26 is operated by the cam shaft 24, the oil dropping passage formed from the crank case 22 to the oil pan 8 is not obstructed. Thus, the oil dropping performance can be improved.

It is to be noted that the present invention is not limited to the described embodiment and many other changes and modifications may be made without departing from the scopes of the appended claims.

What is claimed is:

1. An oil pump unit for an outboard motor having an engine holder arranged to be mounted to a hull, an engine disposed in an upper portion of the engine holder in a mounted state thereof, an oil pain disposed in a lower portion of the engine holder, a crank shaft vertically disposed in the engine, a cam shaft disposed to extend in parallel to the crank shaft, and an oil pump unit disposed to a lower surface of the engine holder and adapted to circulate an oil in the engine, p1 a pump case having a case body to be mounted to the engine holder and a case cap;

a pump drive shaft operatively connected to the cam shaft for operating said oil pump unit;

suction means for sucking an oil; and discharge means for draining the oil, wherein said pump drive shaft is detachably connected to the cam shaft and is slidable in a vertical direction in the mounted state, and said suction means and said discharge means are formed as suction hole and discharge hole which are operatively communicated with suction port and discharge port of the engine, respectively.

2. An oil pump unit for an outboard motor having an engine holder mounted to a hull, an engine disposed above the engine holder and mounted to the engine holder, an oil pain disposed below the engine holder, a crank shaft vertically disposed in the engine, and a cam shaft extending parallel to the crank shaft, said oil pump unit adapted to circulate an oil in the engine being disposed on a lower surface of the engine holder, comprising:

a pump case having a case body for mounting to the engine holder and a case cap;

a pump drive shaft operatively connected to the cam shaft for operating said oil pump unit;

suction means for sucking the oil; and p1 discharge means for draining the oil, wherein said pump drive shaft is detachably connected to the cam shaft and is slidable in a vertical direction, and said suction means and said discharge means are formed as suction hole and discharge hole respectively, operatively communicating with suction port and discharge port of the engine, and wherein a thrust receiver is mounted to the oil pan and is disposed below the pump drive shaft to be coaxial therewith so as to be movable in an axial direction thereof.

3. An oil pump unit for an outboard motor according to claim 2, wherein said pump drive shaft is provided with a top end to which a projection is formed so as to project over the top end of said pump drive shaft and an engaging member having a recess arranged to be engaged with said projection is individually formed at a lower end of the cam shaft in a manner that the pump drive shaft and the cam shaft are connected to each other to be integrally rotatable.

4. An oil pump unit for an outboard motor according to claim 3, said thrust receiver is formed at a central portion thereof with a tool insertion opening extending in an axial direction and said pump drive shaft is formed with a groove at the lower end portion thereof with which a tool is engaged, said tool insertion hole being positioned just below the lower end portion of the pump drive shaft.

5. An oil pump unit for an outboard motor according to claim 4, wherein said engine is provided with an engine cover positioned below the thrust receiver and the engine cover has an inner surface to which a rib for preventing dropping-off of the thrust receiver is formed.

* * * * *